US010417953B2

(12) United States Patent
Yin

(10) Patent No.: US 10,417,953 B2
(45) Date of Patent: Sep. 17, 2019

(54) SOURCE DRIVING CIRCUIT AND DRIVING METHOD THEREOF, AND DISPLAY APPARATUS

(71) Applicant: BOE TECHNOLOGY GROUP CO., LTD., Beijing (CN)

(72) Inventor: Shichang Yin, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 70 days.

(21) Appl. No.: 15/150,616

(22) Filed: May 10, 2016

(65) Prior Publication Data

US 2017/0004759 A1 Jan. 5, 2017

(30) Foreign Application Priority Data

Jul. 1, 2015 (CN) ..... 2015 1 0379849

(51) Int. Cl.
*G09G 3/20* (2006.01)

(52) U.S. Cl.
CPC ... *G09G 3/2092* (2013.01); *G09G 2310/0286* (2013.01); *G09G 2330/021* (2013.01)

(58) Field of Classification Search
CPC ..... G09G 3/2092; G09G 2310/0286; G09G 2330/021
See application file for complete search history.

(56) References Cited

U.S. PATENT DOCUMENTS

2006/0290637 A1* 12/2006 Kang ..... G09G 3/3688 345/98
2006/0290638 A1* 12/2006 Kang ..... G09G 3/2011 345/98
2006/0291298 A1* 12/2006 Kang ..... G09G 3/3688 365/189.07
2008/0136765 A1* 6/2008 Neugebauer ..... G02F 1/13624 345/98
2009/0219265 A1* 9/2009 Lee ..... G09G 3/3291 345/205
2012/0299894 A1* 11/2012 Bae ..... G09G 3/3614 345/211

FOREIGN PATENT DOCUMENTS

CN 102637415 A 8/2015

OTHER PUBLICATIONS

Second Chinese Office Action dated Aug. 7, 2017.

* cited by examiner

*Primary Examiner* — Brent D Castiaux
(74) *Attorney, Agent, or Firm* — Dilworth & Barrese, LLP; Michael J. Musella, Esq.

(57) ABSTRACT

Provided are a source driving circuit and driving method thereof, and a display apparatus. The driving method of the source driving circuit comprises: the source driving circuit outputting a display data signal when preparing to charge one pixel electrode, the source driving circuit stopping outputting the display data signal when the display data signal reaches a target value, the time when the display data signal reaches the target value being earlier than the time when the charging of the one pixel electrode is completed; and the source driving circuit resuming outputting the display data signal when preparing to charge the next pixel electrode. It is possible to reduce the power consumption of the source driving circuit and thus reduce the power consumption of the display apparatus.

20 Claims, 3 Drawing Sheets

SOURCE DRIVING CIRCUIT AND DRIVING METHOD THEREOF, AND DISPLAY APPARATUS

TECHNICAL FIELD OF THE DISCLOSURE

The present disclosure relates to a source driving circuit and driving method thereof, and a display apparatus.

BACKGROUND

A display apparatus comprises an array substrate, a source driving circuit and a gate driving circuit. In particular, on the array substrate, there are arranged gate lines and data lines that are crossing each other, TFTs (Thin Film Transistors) and pixel electrodes. The gate lines are connected to the gate driving circuit, the data lines are connected to the source driving circuit, gates of the TFTs are connected to the gate lines, sources of the TFTs are connected to the data lines, and drains of the TFTs are connected to the pixel electrodes.

The display procedure of a display apparatus with the above structure is as follows. The gate driving circuit scans the gate lines line by line to turn on the TFTs line by line; at the same time, the source driving circuit outputs display data signals to all the data lines simultaneously. The display data signals are transmitted to the sources of the TFTs that are turned on through the data lines, and applied to the pixel electrodes through the drains of the TFTs to charge the pixel electrodes.

SUMMARY

At least one embodiment of the present disclosure provides a source driving circuit and driving method thereof, and a display apparatus, which can reduce the power consumption of the source driving circuit and thus reduce the power consumption of the display apparatus.

According to one aspect of the present disclosure, there is provided a driving method of a source driving circuit, comprising: outputting a display data signal by the source driving circuit when preparing to charge one pixel electrode; stopping outputting the display data signal by the source driving circuit when the display data signal reaches a target value, the time when the display data signal reaches the target value being earlier than the time when the charging of the one pixel electrode is completed; and resuming outputting the display data signal by the source driving circuit when preparing to charge the next pixel electrode.

In the driving method of a source driving circuit provided by the present disclosure, when preparing to charge a pixel electrode, the source driving circuit outputs a display data signal, when the display data signal reaches a target value, the source driving circuit stops outputting the display data signal, and the source driving circuit resumes outputting the display data signal when preparing to charge the next pixel electrode. Since the time when the display data signal reaches the target value is earlier than the time when the charging of the one pixel electrode is completed, in the display procedure of the display apparatus, the source driving circuit does not always output the display data signal, rather, it outputs the display data signal in part of the time. Therefore, the time for the source driving circuit to output the display data signal is shortened, reducing the power consumption of the source driving circuit, and thus reducing the power consumption of the display apparatus.

According to another aspect of the present disclosure, there is provided a source driving circuit comprising an output buffer, an output terminal of the output buffer being connected to a data line, wherein when preparing to charge one pixel electrode, the output buffer outputs a display data signal to the data line, when the display data signal reaches a target value, the output buffer stops outputting the display data signal, and the time when the display data signal reaches the target value is earlier than the time when the charging of the one pixel electrode is completed; and the output buffer resumes outputting the display data signal when preparing to charge the next pixel electrode.

In the source driving circuit provided in the present disclosure, an output buffer connected to the data lines is provided. When preparing to charge a pixel electrode, the output buffer is used to output a display data signal to a data line, when the display data signal reaches a target value, the output buffer stops outputting the display data signal, and the output buffer resumes outputting the display data signal when preparing to charge the next pixel electrode. Since the time when the display data signal reaches the target value is earlier than the time when the charging of the one pixel electrode is completed, in the display procedure of the display apparatus, the source driving circuit does not always output the display data signal, rather, it outputs the display data signal in part of the time. Therefore, the time for the source driving circuit to output the display data signal is shortened, reducing the power consumption of the source driving circuit, and thus reducing the power consumption of the display apparatus.

According to yet another aspect of the present disclosure, there is provided a display apparatus comprising the source driving circuit described in the above. The display apparatus has the same benefit as the above source driving circuit, which will not be repeated herein.

DETAILED DESCRIPTION

In the following, technical solutions in embodiments of the present disclosure will be clearly and completely described in connection with figures. Obviously, the described embodiments are only part embodiments of the present disclosure, rather than all the embodiments.

The inventor(s) of the present application found that, in the display procedure described in the background, in the procedure from preparing to charge one pixel electrode to the charging of the pixel electrode is completed, the source driving circuit always outputs the display data signal to the data line, resulting in that the power consumption of the source driving circuit is large and the power consumption of the display apparatus is large.

First Embodiment

An embodiment of the present disclosure provides a driving method of a source driving circuit, comprising: the source driving circuit outputting a display data signal when preparing to charge one pixel electrode; the source driving circuit stopping outputting the display data signal when the display data signal reaches a target value, the time when the display data signal reaches the target value being earlier than the time when the charging of the one pixel electrode is completed; and the source driving circuit resuming outputting the display data signal when preparing to charge the next pixel electrode.

Figure 1:
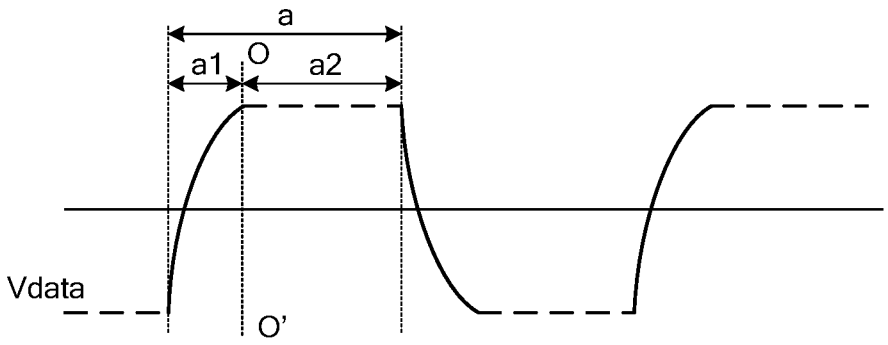
FIG. 1 is a time sequence diagram of a display data signal in an embodiment of the present disclosure.

The time sequence of the display data signal output by the source driving circuit is as shown in FIG. 1. In FIG. 1, the procedure from preparing to charge a pixel electrode to the charging of the pixel electrode is completed is represented by a. The procedure a is divided into two time periods. In the first time period a1, the source driving circuit outputs a display data signal Vdata which is represented by a solid line in FIG. 1. In the second time period a2, the source driving circuit does not output the display data signal Vdata which is represented by a dashed line in FIG. 1. The delimitation line OO' between the first time period a1 and the second time period a2 is the time when the display data signal Vdata reaches the target value.

It is noted that the above "target value" refers to a charging value required for charging one pixel electrode.

In order for those skilled in the art to better understand the advantages of the driving method in embodiments of the present disclosure, description will be made in the following, in connection with the time sequence diagram of the display data signal Vdata output by the source driving circuit in embodiments of the present disclosure and the time sequence diagram of the display data signal Vdata output by the source driving circuit in a known technical solution.

Figure 2:
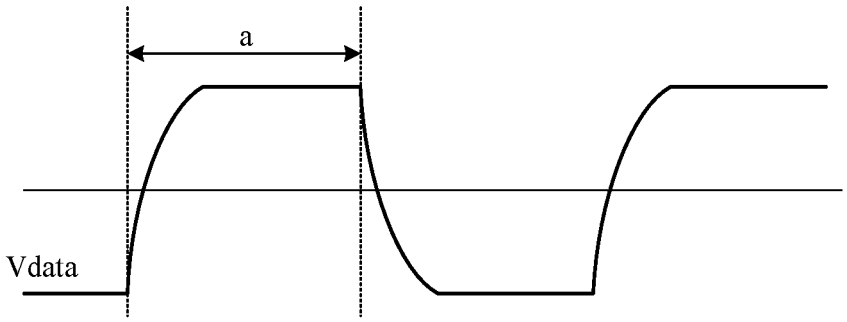
FIG. 2 is a time sequence diagram of a display data signal in a known technical solution.

For example, when a driving method of a known technical solution is used to drive a source driving circuit, the time sequence of the display data signal output by the source driving circuit is as shown in FIG. 2. It can be clearly seen from FIG. 2 that, in the procedure a from preparing to charge the pixel electrode to the charging of the pixel circuit is completed, the source driving circuit continuously outputs the display data signal Vdata such that the time for the source driving circuit to output the display data signal Vdata is long. Therefore, the power consumption of the source driving circuit is large and the power consumption of the display apparatus is large. When a driving method provided by an embodiment of the present disclosure is used to drive the source driving circuit, the time sequence diagram of the display data signal Vdata output by the source driving circuit is as shown in FIG. 1. It can be clearly seen from FIG. 1 that, in the procedure a from preparing to charge the pixel electrode to the charging of the pixel circuit is completed, the source driving circuit only outputs the display data signal Vdata in part of the time, that is, only outputs the display data signal Vdata before the display data signal Vdata reaches the target value. The time for the source driving circuit to output the display data signal Vdata is notably shorter than the time for the source driving circuit to output the display data signal Vdata in the known technical solution, such that the power consumption of the source driving circuit can be effectively reduced and then the power consumption of the display apparatus can be effectively reduced.

Figure 3:
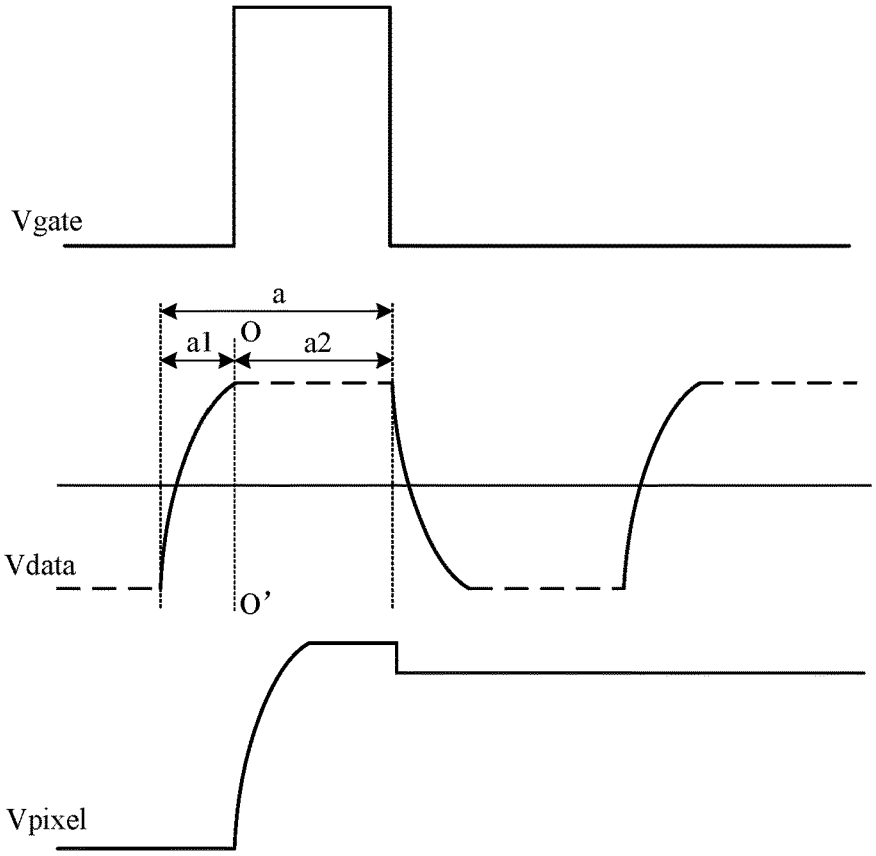
FIG. 3 is time sequence diagrams of a display data signal, a gate driving signal and the voltage of a pixel electrode in an embodiment of the present disclosure.

Exemplarily, in the above procedure a, the relationship between the gate driving signal Vgate, the voltage Vpixel of the pixel electrode and the display data signal Vdata is as shown in FIG. 3. Before the display data signal Vdata reaches the target value, the gate driving signal Vgate is at a low level to make the TFT connected to the pixel electrode turn off, the display data signal Vdata cannot be transmitted to the pixel electrode, and the pixel electrode is not charged. When the display data signal Vdata reaches the target value, the gate driving signal Vgate becomes to be at a high level to make the TFT connected to the pixel electrode turn on, and the display data signal Vdata can be transmitted to the pixel electrode such that the pixel electrode starts to be charged. In addition, when the display data signal Vdata output by the source driving circuit reaches the target value, the source driving circuit stops outputting the display data signal Vdata.

Figure 4:
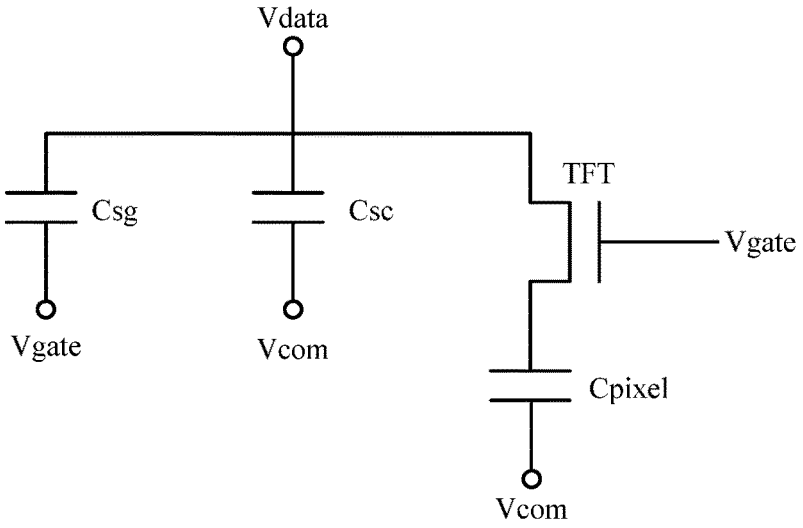
FIG. 4 is an equivalent circuit diagram of one pixel in an embodiment of the present disclosure.

As can be seen from FIG. 3, in the driving method of the source driving circuit provided by an embodiment of the present disclosure, when preparing to charge a pixel electrode, the source driving circuit outputs a display data signal Vdata, and when the display data signal Vdata reaches a target value, the source driving circuit stops outputting the display data signal Vdata, wherein the time when the display data signal Vdata reaches the target value is earlier than the time when the charging of the one pixel electrode is completed; however, the charging effect of the pixel electrode is not affected (in FIG. 3, the voltage drop of the pixel electrode Vpixel is caused by leakage current when the TFT is turned off due to that the gate driving signal becomes to be at a low level, and has nothing to do with the charging effect of the pixel electrode). The reason is as follows. As shown in FIG. 4, a pixel electrode and a common electrode on the array substrate form a pixel capacitor Cpixel, parasitic capacitor Csc is formed between the common electrode line and the data line on the array substrate, and parasitic capacitor Csg is formed between the gate line and the data line on the array substrate. In the procedure that the source driving circuit outputs the display data signal Vdata to the data line, it can not only charge the pixel capacitor Cpixel, but also charge the parasitic capacitors Csc and Csg. After the source driving circuit stops outputting the display data signal Vdata to the data line, the parasitic capacitors Csc and Csg will be discharged, and thus continue to charge the pixel capacitor Cpixel. Since the capacitance of the parasitic capacitors Csc and Csg is usually at the magnitude of pF and the capacitance of the pixel capacitor Cpixel is usually at the magnitude of fF, the capacitance of the parasitic capacitors Csc and Csg is much larger than the capacitance of the pixel capacitor Cpixel. Therefore, when the source driving circuit stops outputting the display data signal Vdata to the data line, the charges released by the parasitic capacitors Csc and Csg are enough to maintain normal charging of the pixel capacitor Cpixel, and thus realize normal displaying of the display apparatus.

Figure 5:
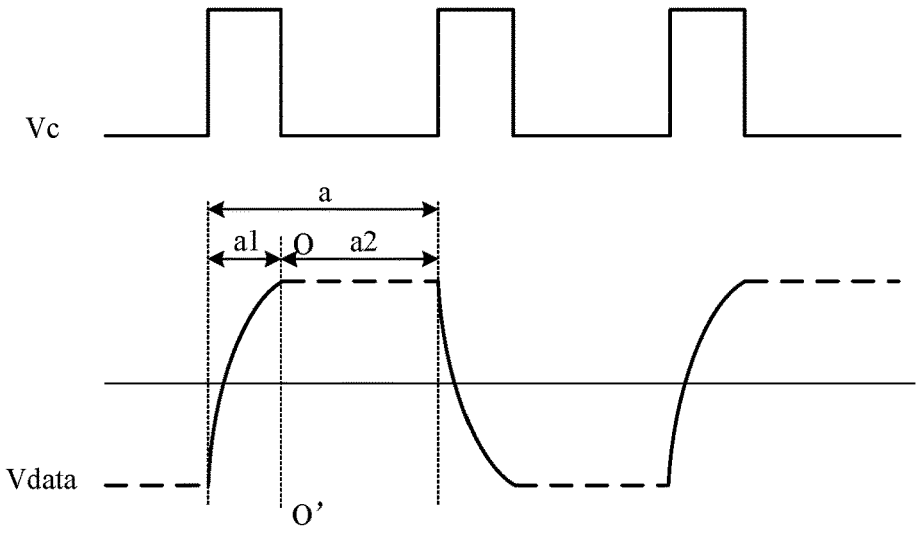
FIG. 5 is time sequence diagrams of a start-stop control signal and a display data signal in an embodiment of the present disclosure.

In the driving method of the source driving circuit provided in the present embodiment, as shown in FIG. 5, it is possible to control the source driving circuit by a start-stop control signal Vc as to whether to output the display data signal Vdata. For example, in the procedure of charging one pixel electrode, firstly, the start-stop control signal Vc controls the source driving circuit to output the display data signal Vdata until the display data signal reaches the target value; then the level of the start-stop control signal Vc is changed to control the source driving circuit to stop outputting the display data signal Vdata until the charging of the the next pixel electrode; then the level of the start-stop control signal Vc is changed again to control the source driving circuit to resume outputting the display data signal Vdata.

Further, for example, as shown in FIG. 5, the step of controlling the source driving circuit by a start-stop control signal as to whether to output the display data signal Vdata comprises: the start-stop control signal Vc having a first level and a second level, and when the start-stop control signal Vc is at the first level, the source driving circuit outputting the display data signal Vdata; when the start-stop control signal Vc is at the second level, the source driving circuit not outputting the display data signal Vdata. Exemplarily, the start-stop control signal can control the turning-on and off of a start-stop control switch to control the source driving circuit as to whether to output the display data signal Vdata. When the start-stop control switch is a N type TFT, the first level is a high level, and the second level is a low level; when the start-stop control switch is a P type TFT, the first level is a low level, and the second level is a high level, such that when the start-stop control signal is at the first level, the start-stop control switch is turned on and the source driving circuit outputs the display data signal, and when the start-stop control signal is at the second level, the start-stop control switch is turned off and the source driving circuit does not output the display data signal.

It is noted that the start-stop control signal is only one implementation of controlling the source driving circuit as to whether to output the display data signal. There can be many ways for controlling the source driving circuit as to whether to output the display data signal, and those skilled in the art can select among them as practically needed.

In a driving method of a source driving circuit provided by an embodiment of the present disclosure, when preparing to charge a pixel electrode, the source driving circuit outputs a display data signal, when the display data signal reaches a target value, the source driving circuit stops outputting the display data signal, and the source driving circuit resumes outputting the display data signal when preparing to charge the next pixel electrode. Since the time when the display data signal reaches the target value is earlier than the time when the charging of the one pixel electrode is completed, in the display procedure of the display apparatus, the source driving circuit does not always output the display data signal, rather, it outputs the display data signal in part of the time. Therefore, the time for the source driving circuit to output the display data signal is shortened, reducing the power consumption of the source driving circuit, and thus reducing the power consumption of the display apparatus.

Second Embodiment

Figure 6:
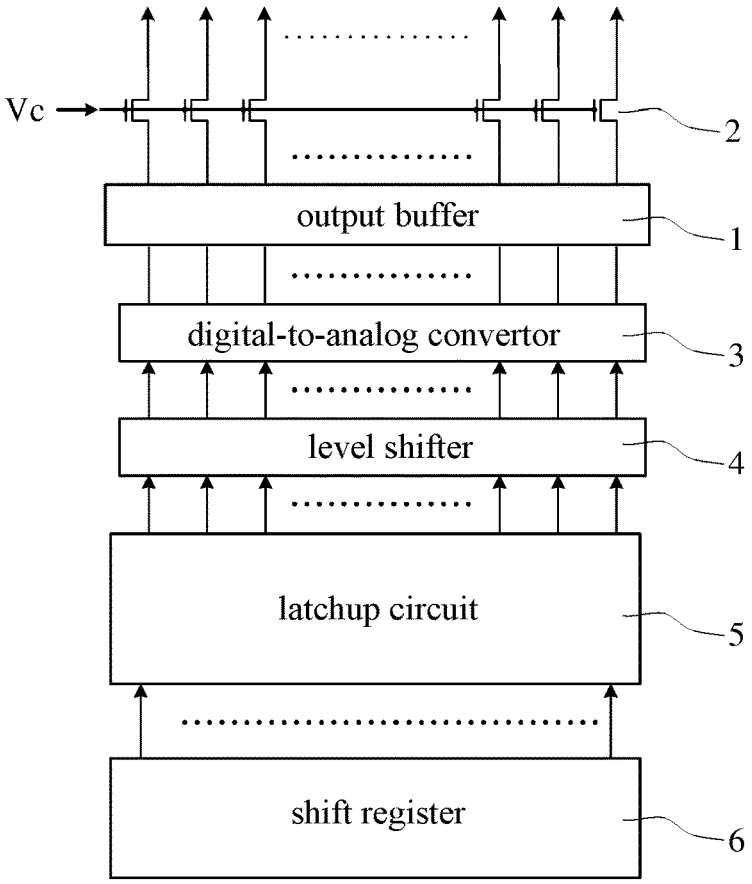
FIG. 6 is a schematic diagram of a structure of a source driving circuit in an embodiment of the present disclosure.

An embodiment of the present disclosure provides a source driving circuit employing the driving method of a source driving circuit described in the first embodiment. As shown in FIG. 6, the source driving circuit comprises an output buffer 1, and output terminals of the output buffer 1 are connected to data lines respectively. In the procedure of preparing to charge one pixel electrode, the output buffer 1 outputs a display data signal to the data lines, when the display data signal reaches a target value, the output buffer 1 stops outputting the display data signals, the time when the display data signal reaches the target value is earlier than the time when the charging of the one pixel electrode is completed, and the output buffer 1 resumes outputting the display data signal when preparing to charge the next pixel electrode.

It is noted that two components connecting to each other mentioned in embodiments of the present disclosure should be understood as that signals can be transmitted between the two components and the signals may be processed during transmission, but should not be narrowly understood as that the two components are connected only by conducting wires.

When the above source driving circuit is used for displaying, before the display data signal reaches the output buffer 1, it is not suitable to drive a pixel electrode as its signal amplitude is too small. Therefore, the display data signal is subject to amplification when passing the output buffer 1, and thus converted to a signal suitable to drive the pixel electrode. Then the display data signal is applied to the pixel electrode through a data line.

In order to facilitate controlling the output buffer 1 as to whether to output the display data signal, as shown in FIG. 6, the source driving circuit in an embodiment of the present disclosure further comprises a start-stop control switch 2 which is used to control the output buffer 1 as to whether to output a display data signal to a data line according to a start-stop control signal. Exemplarily, the source driving circuit in an embodiment of the present disclosure can further comprise a start-stop control signal input terminal for inputting the start-stop control signal.

Exemplarily, the start-stop control switch 2 is a TFT whose gate is used to receive the start-stop control signal. Further, the start-stop control signal has a first level and a second level, when the TFT is of N type, the first level is a high level and the second level is a low level, when the TFT is of P type, the first level is a low level and the second level is a high level, such that when the start-stop control signal is at the first level, the start-stop control switch 2 is turned on and the source driving circuit outputs the display data signal, and when the start-stop control signal is at the second level, the start-stop control switch 2 is turned off and the source driving circuit does not output the display data signal.

It is noted that, in implementation, it suffices that the start-stop control switch 2 is installed in the transmission path of the display data signal to be able to form a high impedance (Hi-Z) zone in the transmission path of the display data signal to block the transmission of the display data signal and further to control the source driving circuit as to whether to output the display data signal. In embodiments of the present disclosure, for example, the start-stop control switches 2 are connected between the output terminals of the output buffer 1 and the data lines, such that the source driving circuit in an embodiment of the present disclosure can be formed just by connecting the start-stop control switches 2 between the output terminals of the source driving circuit and the data lines in the known technical solutions. Its operation is easy and its manufacturing cost is low. Now, when the start-stop control switches 2 are TFTs, it is possible to form the start-stop control switches directly on the peripheral area of the array substrate. The start-stop control switches 2 can be formed simultaneously with other structures on the array substrate, such that it is possible to further simplify the manufacturing process of the source driving circuit in embodiments of the present disclosure and reduce the manufacturing cost of the source driving circuit in embodiments of the present disclosure.

In addition, as shown in FIG. 6, the source driving circuit further comprises a digital-to-analog convertor 3, a level shifter 4, a latchup circuit 5 and a shift register 6. An output terminal of the digital-to-analog convertor 3 is connected to an input terminal of the output buffer 1, an input terminal of the digital-to-analog convertor 3 is connected to an output terminal of the level shifter 4, an input terminal of the level shifter 4 is connected to an output terminal of the latchup circuit 5, and an input terminal of the latchup circuit 5 is connected to an output terminal of the shift register 6.

The shift register 6 is used to generate a sampling signal in time sequence. The latchup circuit 5 is used to sequentially sample image data of the rows to be displayed under the control of the sampling signal and latch sampled first image data of the row in digital form. The level shifter 4 is used to adjust the level of the first image data and then output second image data in digital form. The digital-to-analog converter 3 is used to convert the second image data in digital form into an analog voltage. The output buffer 1 is used to amplify and output the analog voltage. The specific structures of the above output buffer 1, digital-to-analog convertor 3, level shifter 4, latchup circuit 5 and shift register 6 can refer to known technical solutions, which will not be repeated herein.

In the source driving circuit provided in the present disclosure, an output buffer connected to the data lines is provided. When preparing to charge a pixel electrode, the output buffer is used to output a display data signal to a data line, when the display data signal reaches a target value, the output buffer stops outputting the display data signal, and the output buffer resumes outputting the display data signal when preparing to charge the next pixel electrode. Since the time when the display data signal reaches the target value is earlier than the time when the charging of the one pixel electrode is completed, in the display procedure of the display apparatus, the source driving circuit does not always output the display data signal, rather, it outputs the display data signal in part of the time. Therefore, the time for the source driving circuit to output the display data signal is shortened, reducing the power consumption of the source driving circuit, and thus reducing the power consumption of the display apparatus.

Further, the present disclosure further provides a display apparatus comprising the above described source driving circuit. The display apparatus has the same benefit as the above source driving circuit, which will not be repeated herein. The display apparatus can be any product or component with a display function such as a liquid crystal panel, electronic paper, a liquid crystal television, a liquid crystal display, a digital photo frame, a cell phone, a tablet or the like.

The embodiments in the specification are described progressively, same or similar parts of the embodiments can refer to each other, and each embodiment emphasizes its differences from other embodiments. In particular, for the apparatus embodiment, since it is substantially similar to the method embodiment, its description is relatively simple and omitted parts can refer to the related parts of the method embodiment.

The above descriptions are only specific implementations of the present disclosure, but the protection scope of the present disclosure is not limited to this. Changes or replacements that can be easily devised by those skilled in the art within the technical scope of the present disclosure should all fall within the protection scope of the present disclosure. Therefore, the protection scope of the present disclosure should be defined by the protection scope of the claims.

What is claimed is:

1. A driving method of a source driving circuit, comprising:

outputting a display data signal by the source driving circuit to store electric charges in parasitic capacitance of one pixel electrode, wherein before the display data signal reaches a target value, the display data signal is not transmitted to said one pixel electrode by turning off a thin film transistor TFT connected to said one pixel electrode so that said pixel electrode cannot be charged;

stopping outputting the display data signal by the source driving circuit when the display data signal reaches the target value and turning on the TFT to charge said one pixel electrode by the electric charges stored in the parasitic capacitance, the time when the display data signal reaches the target value being earlier than the time when the charging of the one pixel electrode is completed; and resuming outputting the display data signal by the source driving circuit to charge a next pixel electrode, wherein the target value is a charging voltage value required for charging said one pixel electrode.

2. The driving method of a source driving circuit according to claim 1, comprising:

controlling the source driving circuit by a start-stop control signal as to whether to output the display data signal.

3. The driving method of a source driving circuit according to claim 2, wherein said controlling the source driving circuit by a start-stop control signal as to whether to output the display data signal comprises:

the start-stop control signal having a first level and a second level, and when the start-stop control signal is at the first level, outputting the display data signal by the source driving circuit; when the start-stop control signal is at the second level, not outputting the display data signal by the source driving circuit.

4. A source driving circuit comprising an output buffer, an output terminal of the output buffer being connected to a data line, wherein the output buffer outputs a display data signal to the data line to store electric charges in parasitic capacitance of one pixel electrode, wherein before the display data signal reaches a target value, the display data signal is not transmitted to said one pixel electrode by turning off a thin film transistor TFT connected to said one pixel electrode so that said pixel electrode cannot be charged; and when the display data signal reaches the target value, the output buffer stops outputting the display data signal and turns on the TFT to charge said one pixel electrode by the electric charges stored in the parasitic capacitance, and the time when the display data signal reaches the target value is earlier than the time when the charging of the one pixel electrode is completed; and the output buffer resumes outputting the display data signal to charge a next pixel electrode, wherein the target value is a charging voltage value required for charging said one pixel electrode.

5. The source driving circuit according to claim 4, wherein the source driving circuit further comprises a start-stop control switch which is used to control the output buffer as to whether to output the display data signal to the data line according to a start-stop control signal.

6. The source driving circuit according to claim 5, wherein the start-stop control switch is a TFT whose gate is used to receive the start-stop control signal.

7. The source driving circuit according to claim 6, wherein the start-stop control signal has a first level and a second level; when the TFT is of N type, the first level is a high level, and the second level is a low level; when the TFT is of P type, the first level is a low level, and the second level is a high level.

8. The source driving circuit according to claim 5, wherein the start-stop control switch is connected between the output terminal of the output buffer and the data line.

9. The source driving circuit according to claim 4, further comprising a digital-to-analog convertor, a level shifter, a latchup circuit and a shift register, wherein an output terminal of the digital-to-analog convertor is connected to an input terminal of the output buffer, an input terminal of the digital-to-analog convertor is connected to an output terminal of the level shifter, an input terminal of the level shifter is connected to an output terminal of the latchup circuit, and an input terminal of the latchup circuit is connected to an output terminal of the shift register.

10. A display apparatus comprising the source driving circuit according to claim 4.

11. The source driving circuit according to claim 6, wherein the start-stop control switch is connected between the output terminal of the output buffer and the data line.

12. The source driving circuit according to claim 7, wherein the start-stop control switch is connected between the output terminal of the output buffer and the data line.

13. The source driving circuit according to claim 5, further comprising a digital-to-analog convertor, a level shifter, a latchup circuit and a shift register, wherein an output terminal of the digital-to-analog convertor is connected to an input terminal of the output buffer, an input terminal of the digital-to-analog convertor is connected to an output terminal of the level shifter, an input terminal of the level shifter is connected to an output terminal of the latchup circuit, and an input terminal of the latchup circuit is connected to an output terminal of the shift register.

14. The source driving circuit according to claim 6, further comprising a digital-to-analog convertor, a level shifter, a latchup circuit and a shift register, wherein an output terminal of the digital-to-analog convertor is connected to an input terminal of the output buffer, an input terminal of the digital-to-analog convertor is connected to an output terminal of the level shifter, an input terminal of the level shifter is connected to an output terminal of the latchup circuit, and an input terminal of the latchup circuit is connected to an output terminal of the shift register.

15. The source driving circuit according to claim 7, further comprising a digital-to-analog convertor, a level shifter, a latchup circuit and a shift register, wherein an output terminal of the digital-to-analog convertor is connected to an input terminal of the output buffer, an input terminal of the digital-to-analog convertor is connected to an output terminal of the level shifter, an input terminal of the level shifter is connected to an output terminal of the latchup circuit, and an input terminal of the latchup circuit is connected to an output terminal of the shift register.

16. The source driving circuit according to claim 8, further comprising a digital-to-analog convertor, a level shifter, a latchup circuit and a shift register, wherein an output terminal of the digital-to-analog convertor is connected to an input terminal of the output buffer, an input terminal of the digital-to-analog convertor is connected to an output terminal of the level shifter, an input terminal of the level shifter is connected to an output terminal of the latchup circuit, and an input terminal of the latchup circuit is connected to an output terminal of the shift register.

17. The display apparatus according to claim 10, wherein the source driving circuit further comprises a start-stop control switch which is used to control the output buffer as to whether to output the display data signal to the data line according to a start-stop control signal.

18. The display apparatus according to claim 17, wherein the start-stop control switch is a TFT whose gate is used to receive the start-stop control signal.

19. The display apparatus according to claim 18, wherein the start-stop control signal has a first level and a second level; when the TFT is of N type, the first level is a high level, and the second level is a low level; when the TFT is of P type, the first level is a low level, and the second level is a high level.

20. The display apparatus according to claim 17, wherein the start-stop control switch is connected between the output terminal of the output buffer and the data line.

* * * * *